United States Patent [19]

Van Benthuysen

[11] 4,101,864

[45] Jul. 18, 1978

[54] VARIABLE RESISTANCE SLIDE CONTROL

[75] Inventor: John D. Van Benthuysen, Elkhart, Ind.

[73] Assignee: CTS Corporation, Elkhart, Ind.

[21] Appl. No.: 755,850

[22] Filed: Dec. 30, 1976

[51] Int. Cl.[2] ..... H01C 10/44

[52] U.S. Cl. ..... 338/183; 338/160; 338/176

[58] Field of Search ..... 338/176, 183, 184, 160, 338/161

[56] References Cited

U.S. PATENT DOCUMENTS

| | | | |
|---|---|---|---|
| 3,732,521 | 5/1973 | Hauenstine et al. | 338/183 X |
| 3,738,327 | 5/1973 | Rozema et al. | 338/183 |

*Primary Examiner*—C. L. Albritton
*Attorney, Agent, or Firm*—John J. Gaydos

[57] ABSTRACT

A variable resistance slide control includes a housing having a front wall and having a side wall that is integral therewith. A dielectric base having a resistance element and a collector member mounted thereon is secured to the housing in spaced parallel relationship to the side wall. A contactor member engaging the resistance element and collector member is constrained to move with a slider that includes a handle portion projecting outwardly of the housing through an elongated slot which is defined by the front wall and the base. The slider includes a slider block portion with a guide groove therein interfitting with a longitudinal rail that is integral with the dielectric base, and the slider block portion slidably engages an inner surface of the side wall. A second rail is integral with the dielectric base and includes a guide surface that is slidably engageable with the slider block portion.

14 Claims, 5 Drawing Figures

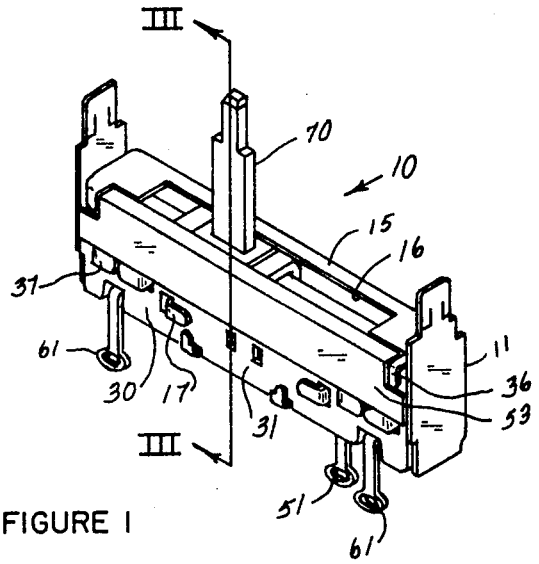
FIGURE 1
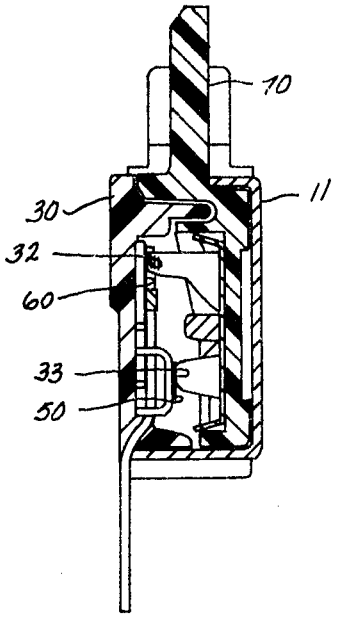
FIGURE 3
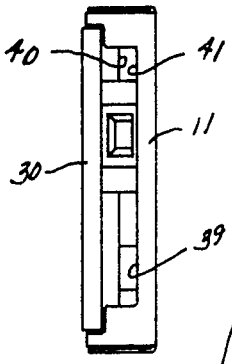
FIGURE 2
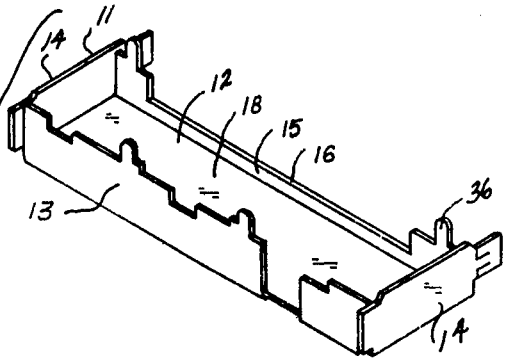
FIGURE 4
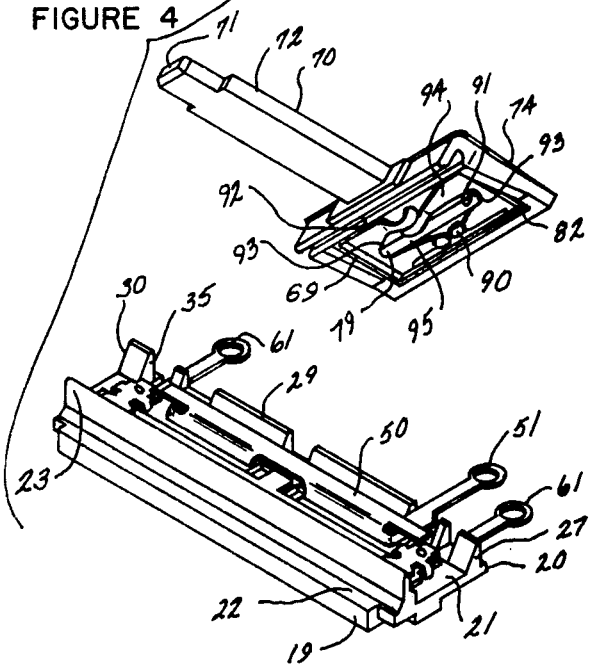
FIGURE 5
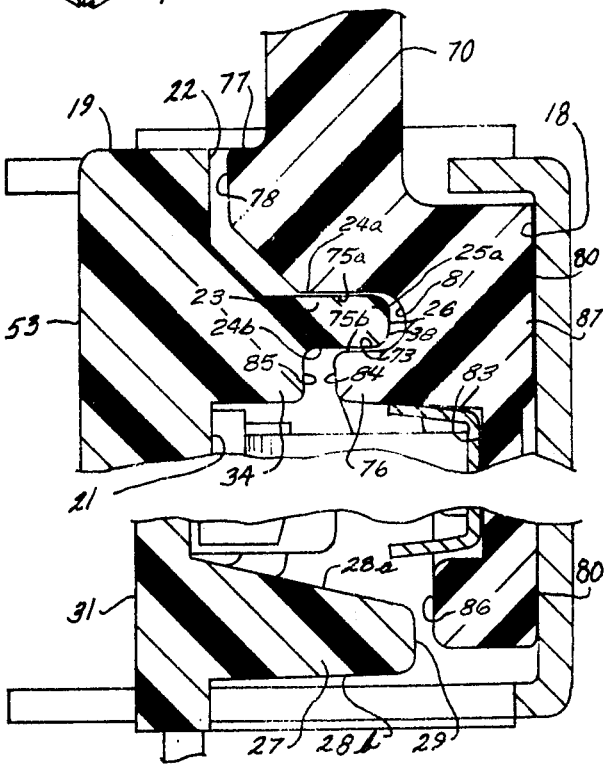

VARIABLE RESISTANCE SLIDE CONTROL

BACKGROUND OF THE INVENTION

1. Field of the Invention

The present invention relates to a variable resistance control and, more particularly, to a variable resistance slide control having a slider that is movable rectilinearly in the housing.

2. Description of the Prior Art

Variable resistance slide controls that are provided with a slider carrying a contactor member that wipingly engage a resistance element and a collector member are well known in the art, some of such controls being exemplified in U.S. Pat. Nos. 3,588,779; 3,732,521 and 3,735,327. In certain of these prior art slide controls, the housing is made from two substantially identical molded half sections joined to leave a slot in the front wall of the housing, and a slider having a handle portion extending through the slot constrains a contactor member to wipingly engage the resistance element and collector member that are mounted in the housing. The slider bears on the front wall of the housing of the joined half sections defining the slot and, during movement rectilinearly along the slot, the slider frequently jumps, skips or rocks. This erratic motion of the slider is caused in part by misalignment of the two spaced surfaces of the front wall that are formed upon joining together the two half sections of the housing, thus causing the slider to bear unevenly on the surfaces supporting the slider. Erratic motion of the slider is also partially caused by the large tolerances required in the manufacture and assembly of the half sections of the housing and slider. It would therefore be desirable to provide a variable resistance slide control having smoother and more uniform slider movement.

Prior art slide controls are provided with an elongated longitudinal slot through which the handle portion of the slider projects. Various means have been suggested for closing the slot in order to prevent exposure of the resistance element and prevent ingress of harmful objects into the control. Generally, such closing means increases the cost and complexity of manufacture. The slide control shown in U.S. Pat. No. 3,887,892, assigned to the same assignee as the present invention, attempts to solve this problem by moving the longitudinal slot from the front wall to a side wall, the front wall serving as a guide rail for the slider. This has presented difficulties because the front wall, being made from a metal stamping, is not free from burrs and other deformities and therefore causes the slider to be subject to binding. It is therefore desirable to provide a variable resistance slide control that can be assembled and manufactured in a simple and facile manner, that is protected against the ingress of foreign materials into the housing, and wherein the plastic slider rides upon a polished plastic surface of compatible material to prevent binding.

Prior art controls as shown in U.S. Pat. No. 3,887,892 utilize the dielectric base as a side wall of the housing. The collector member and the terminals of the resistance element are crimped through apertures in the base and are exposed on the outside surface. These controls, when mounted near a metal chassis or the like, require additional external insulation means to prevent shorting of the terminals to the external structures. It is therefore desirable to provide economical protection for such controls to prevent such shorting.

Prior art slide controls, as exemplified in U.S. Pat. Nos. 3,735,327; 3,732,521 and 3,887,892, are provided with a contactor member which is mounted and supported to the slide at a formed portion. A formed structure cannot be as accurately produced as a stamped or blanked structure because the size and shape of a blanked part is precisely defined by a matching punch and die whereas formed contours include some variation from spring-back of the material. The use of a blanked portion of the contactor member for locating the contactor member with respect to the slider improves the accuracy of positioning and controlling the contactor member. It is therefore desirable to provide a slide control wherein the contactor member is supported and guided by the slide at a blanked portion of the contactor member.

SUMMARY OF THE INVENTION

Accordingly, it is an object of the present invention to provide an improved variable resistance slide control. A further object of the present invention is to provide a variable resistance slide control wherein the slide is guided on rails of a compatible material and capable of having a polished surface. A further object of the present invention is to provide a variable resistance slide control wherein ingress of foreign matter into the control is limited. Yet another object of the present invention is to provide a variable resistance slide control wherein the slide is adequately supported to prevent wobble or tilting of the slide. Still another object of the present invention is to provide a variable resistance slide control wherein the slide is not subjected to binding during movement. Still another object of the present invention is to provide a variable resistance slide control wherein the crimped attaching tabs of the terminals of the control extending outwardly from a side of the control are protected from shorting against external structures. A still further object of the present invention is to provide a variable resistance slide control wherein the slide constrains and guides the contactor member at a blanked portion of the contactor member.

Further objects and advantages of the present invention will become apparent as the following description proceeds, and the features of novelty characterizing the invention will be pointed out with particularity in the claims annexed to and forming a part of this specification.

Briefly, the present invention relates to a variable resistance slide control wherein the control operating means or slider comprises a slider block portion; and a guide groove in the slider block portion that slidably engages a longitudinal guide rail that is integral with the base, for rectilinear movement relative to the housing. A handle portion of the control means extends outwardly through an elongated slot at the front, the elongated slot being defined by the front edge of the base and a slot portion of the front wall of the housing. The slider block portion of the control operating means includes a guide surface that slidably engages a longitudinally disposed guide surface inside a side wall of the housing. Two additional elongated and longitudinally disposed guide surfaces on the slider are oppositely disposed for sliding engagement with respective ones of a guide surface on a raised rail and a guide surface near the front edge of the base for limiting lateral movement of the slider toward the base.

For a better understanding of the present invention, reference may be had to the accompanying drawings wherein the same reference numerals have been applied to like parts and wherein:

BRIEF DESCRIPTION OF THE DRAWINGS

FIG. 1 is an isometric view of the preferred embodiment of the variable resistance slide control being made in accordance with the present invention;

FIG. 2 is a plan view of the variable resistance slide control of FIG. 1;

FIG. 3 is a sectional view of FIG. 1, on an enlarged scale, taken generally along lines III—III of FIG. 1;

FIG. 4 is an exploded view of the control shown in FIG. 1 with the contactor member being assembled to the slider and the housing being rotated; and FIG. 5 is a sectional view similar to FIG. 3, but on an even larger scale than that of FIG. 3.

DESCRIPTION OF THE PREFERRED EMBODIMENT

Referring now to FIGS. 1-4 of the drawings, there is illustrated a variable resistance slide control, generally indicated at 10, comprising a housing portion or housing means 11, an elongated dielectric base or housing portion 30, an elongated collector member 50, an elongated resistance element 60, a control operating means or slider 70, and a contactor member 90. The housing portion 11 is secured to the base 30 by a plurality of tabs 36 which are integral with the housing portion 11.

The housing portion 11 includes a side wall 12 having an elongated inner guide surface 18, a rear wall 13, a pair of end walls 14, and a front wall 15 having a slot portion 16.

Referring now to FIGS. 4 and 5, the elongated dielectric base or housing portion 30 includes an elongated front edge 19, an elongated rear edge 20, an elongated inner mounting surface 21, an elongated front guide surface 22, an elongated front rail 23 having elongated front and rear side surfaces **24*a* and 24*b*, and having a top portion 25 that is of generally semicircular cross-section and that includes an apex 26, an elongated rear rail 27 having elongated front and rear side surfaces 28*a* and 28*b* and an elongated top surface or guide surface 29, and an outer surface 31. The front rail 23 further includes an elongated and longitudinally disposed step portion 34; and the rear rail 27 includes a plurality of notches 35** for the passage therethrough of terminals.

Referring now to FIGS. 1, 3, and 4, the elongated collector member 50 and the resistance element 60 are mounted on the elongated inner mounting surface 21 of the base 30; so that a resistance surface 32 and a collector surface 33 of the resistance element 60 and the collector member 50 are in parallel spaced relationship to the inner guide surface 18 of the side wall 12. The collector member 50 includes a pair of integral tabs 17 which are crimped to secure the collector member 50 to the base 30; and a pair of terminals 61, which make electrical contact with respective ends of the resistance element 60 and include a plurality of tabs 37 that are crimped to secure both the terminals 61 and the resistance element 60 to the base 30. The collector member 50 includes an integral terminal 51 for making electrical contact thereto and for connecting the collector member 50 to an external circuit. For a more detailed description of the above, reference can be made to U.S. Pat. No. 3,887,892 which is expressly incorporated by reference herein.

Referring now to FIGS. 1 - 5, the control operating means or slider 70 is supported within the housing 11 for rectilinear movement with respect to the housing and constrains a contactor member 90 for movement therewith. The contactor member 90 wipingly engages the surfaces 32 and 33 of collector member 50 and the resistance element 60, thereby providing an electrical bridge therebetween for connection to an external electrical circuit.

The slider 70 is molded of plastic material and includes a slider block portion 74 and a handle portion 72. The slider block portion includes an apron 77 and a leg 76 which cooperate to define a longitudinally extending guide groove 73 that includes a rounded portion 81, and front and rear side surfaces, **75*a* and 75*b*. The apron 77 extends farther downward toward the base 30 than the leg 76 and includes an elongated and longitudinally extending guide surface 78. Another longitudinally extending guide surface 86 is included near the rear of the slider block portion 74. In addition, the leg 76 includes a longitudinally extending top surface 84 which may be used to cooperate with a top surface 85 of the step portion 34** as an alternate guide surface.

The side surfaces **75*a* and 75*b* of the guide groove 73 slidably engage respective ones of the side surfaces 24*a* and 24*b* of the front rail 23 to provide means for preventing longitudinal movement of an outer end 71 of the handle portion 72 of the slider 70 without corresponding longitudinal movement of the slider block portion 74, and for preventing binding of the slider block portion 74 during movement thereof by the handle portion 72**.

The slider block portion 74 comprises a generally rectangular and open housing 69 enclosing four upturned edges 92 of the contactor member 90 within four side walls 82 of the open housing 69 and including a contactor support surface 83 that is generally parallel to the inner mounting surface 21 of the base 30 and the inner guide surface 18 of the side wall 12. An elongated protrusion 79 extends outwardly from the support surface 83 and engages the contactor member 90 in an elongated blanked aperture 91 thereof. A pair of spaced runners 80 are longitudinally disposed on the outer surface of the slider block portion 74 and provide an elongated guide surface 87 for engaging the inner guide surface 18 of the side wall 12.

To prevent binding, the surfaces **24*a* and 24*b* of the front rail 23, and the surfaces 75*a* and 75*b* of the guide groove 73, are polished and the materials used for the dielectric base 30 and the slider 70 are chosen from compatible plastics, the exemplary embodiment using a moldable thermoplastic, such as nylon. The front rail 23 and the guide groove 73** may be polished as a secondary operation but in the exemplary embodiment, a high polish on the surface of the mold was found to give satisfactory results.

The contactor member 90 is formed from a spring-like material such as spring brass or the like with the elongated aperture 91 centrally disposed therein and both resistance contact fingers 94 and collector contact fingers 95 being formed downwardly toward the resistance element 60 and the collector member 50. The aperture 91 is formed by a blanking tool and is inherently more accurate in placement and dimension than the four upturned edges 92. The protrusion 79 engages the aperture 91 at ends 93 thereof that are in an unformed portion of the contactor member 90; and this engagement of the protrusion 79 with the aperture 91 in the unformed ends 93 thereof serves to improve the positional accuracy between the two members to permit more accurate placement and movement of the contactor member 90 along the resistance element 60.

The dielectric base 30 forms a side wall of the control 10 and has the electrically active tabs 17 and 37 extending outwardly therefrom, thereby presenting a potential shorting problem. A stepped setoff 53 extends outwardly from the dielectric base 30 to space the tabs 17 and 37 away from potential shorting structures such as a chassis or the like, thereby protecting the tabs 17 and 37 from unintentional contact therewith.

The contactor member 90 resiliently urges the guide surface 87 of the slider 70 into engagement with the inner guide surface 18 of the housing portion 11 for planar guiding therebetween. At this time there is a small clearance space between the front guide surfaces 22 and 78 and between the rear guide surfaces 29 and 86; but a force on the handle portion 70, transversely to the direction of rectilinear movement, will cause one of these pairs of guide surfaces to contact. Thus the guide surfaces 22, 78, 29, and 86 are also a part of planar guiding means for the slider 70. Alternately, the surfaces 84 and 85 may be spaced to supplant either the guide surfaces 22 and 78, the guide surfaces 29 and 86, or both of these pairs of guide surfaces, as a part of the planar guiding means. Preferably all of the guide surfaces of the planar guide means are planar surfaces, and the guide groove 73 is preferably, but not necessarily, of a depth wherein the rounded top surface 38 of the top portion 25 of the front rail 23 does not bottom-out in the guide groove 73, and so is not a part of the planar guiding means.

The slot 39 includes a lower edge 40 which is defined by the base 30 and an upper edge 41 which is defined by the slot portion 16 of the housing portion 11. The top surface 38 of the front rail 23 extends upwardly, with respect to the outer surface 31 of the base 30, above the lower edge 40 of the slot 39, and thereby provides a partial barrier for the exclusion of foreign matter.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed as new and desired to be secured by Letters Patent of the United States is:

1. A variable resistance slide control which comprises a first housing portion having elongated front and rear edges, having an elongated inner mounting surface that is longitudinally disposed intermediate of said edges, and having front and rear guide surfaces that are longitudinally disposed intermediate of said mounting surface and respective ones of said edges;

second housing portion means, having front and rear walls, having a side wall that is intermediate of said front and rear walls and that includes an elongated inner guide surface that is longitudinally disposed intermediate of said front and rear walls, and having a slot portion in said front wall that cooperates with said front edge of said first housing portion to form an elongated slot that is longitudinally disposed intermediate of said housing portions, for cooperating with said first housing portion to substantially enclose said mounting surface and all of said guide surfaces;

resistance and collector means, being longitudinally disposed proximal to said mounting surface and intermediate of said front and rear guide surfaces and being secured to the mounting surface, for providing longitudinally disposed resistance and collector surfaces that are distal from said mounting surface;

terminal means for connecting said resistance and collector means to an external circuit;

contactor means, being enclosed by said housing, for wipingly engaging said resistance and collector surfaces;

control operating means, comprising a slider block portion that is disposed intermediate of said inner guide surface and said contactor means, and comprising a handle portion that extends outwardly through said slot and that includes an outer end, for receiving planar guiding from all three of said guide surfaces, and for moving said contactor means longitudinally along said resistance and collector surfaces; and guide means, comprising cooperating portions of both said slider block and one of said housings, for preventing longitudinal movement of said outer end of said handle portion without substantially corresponding longitudinal movement of said slider block;

said first housing portion including a rail that is longitudinally disposed intermediate of one of said edges and said mounting surface and that further including a longitudinally disposed side surface;

said guide means, and said cooperating portions thereof, comprising said side surface.

2. A variable resistance slide control as claimed in claim 1 in which said rail includes a second longitudinally disposed side surface; and said guide means, and said cooperating portions thereof, comprises said second side surface.

3. A variable resistance slide control which comprises a first housing portion having elongated front and rear edges, having an elongaged inner mounting surface that is longitudinally disposed intermediate of said edges, and having front and rear guide surfaces that are longitudinally disposed intermediate of said mounting surface and respective ones of said edges;

second housing portion means, having front and rear walls, having a side wall that is intermediate of said front and rear walls and that includes an elongated inner guide surface that is longitudinally disposed intermediate of said front and rear walls, and having a slot portion in said front wall that cooperates with said front edge of said first housing portion to form an elongated slot that is longitudinally disposed intermediate of said housing portions, for cooperating with said first housing portion to substantially enclose said mounting surface and all of said guide surfaces;

resistance and collector means, being longitudinally disposed proximal to said mounting surface and intermediate of said front and rear guide surfaces and being secured to the mounting surface, for providing longitudinally disposed resistance and collector surfaces that are distal from said mounting surface;

terminal means for connecting said resistance and collector means to an external circuit;

contactor means, being enclosed by said housing, for wipingly engaging said resistance and collector surfaces;

control operating means, comprising a slider block portion that is disposed intermediate of said inner guide surface and said contactor means, and comprising a handle portion that extends outwardly through said slot and that includes an outer end, for receiving planar guiding from all three of said guide surfaces, and for moving said contactor means longitudinally along said resistance and collector surfaces; and guide means, comprising cooperating portions of both said slider block and one of said housings, for preventing longitudinal movement of said outer end of said handle portion without substantially corresponding longitudinal movement of said slider block;

said first housing portion including front and rear rails that are longitudinally disposed between said mounting surface and respective ones of said edges;

said front rail including first inner and first outer said surfaces;

said rear rail including second inner and second outer side surfaces;

said guide means, and said cooperating portions thereof, comprising two of said side surfaces.

4. A variable resistance control as claimed in claim 3 in which one of said rails includes a longitudinally disposed top surface; and one of said guide surfaces comprises said top surface.

5. A variable resistance slide control which comprises an elongated dielectric base having elongated front and rear edges and an outer surface, having an elongated inner mounting surface that is longitudinally disposed intermediate of said edges, having a first rail that is longitudinally disposed intermediate of one of said edges and said mounting surface and that includes a longitudinally disposed top surface in raised parallel relationship to said mounting surface, and having a second rail that is longitudinally disposed intermediate of the other of said edges and said mounting surface and that includes a first longitudinally disposed guide surface in raised parallel relationship to said mounting surface, and having a second longitudinally disposed guide surface that is intermediate of said mounting surface and said one edge;

resistance and collector means, being longitudinally disposed proximal to said mounting surface and intermediate of said first and second rails, and being secured to said base, for providing resistance and collector surfaces that are disposed distal from said mounting surface and in parallel raised relationship thereto;

terminal means for connecting said resistance and collector means to an external circuit;

housing means, having a side wall, a front wall, and a rear wall, for substantially enclosing said mounting surface and said rails of said base, for providing a third longitudinally disposed guide surface that is in raised parallel relationship to said resistance and collector surfaces, and for cooperating with said base to provide a longitudinally disposed and elongated slot that is intermediate of said front edge of said base and said front wall of said housing means;

contactor means, being enclosed by said housing, for wipingly engaging said resistance and collector surfaces, and control operating means, comprising a slider block portion that is enclosed within said housing intermediate of said third guide surface and said contactor means and that includes a guide groove in sliding engagement with said first rail, and comprising a handle portion that extends outwardly through said slot and that includes an outer end, for moving said contactor means longitudinally along said resistance and collector surfaces, for receiving guiding from all three of said guide surfaces, and for receiving guiding from said engagement of said guide groove and said guide rail to prevent longitudinal movement of said outer end of said handle portion without substantially corresponding longitudinal movement of said slider block.

6. A variable resistance slide control as claimed in claim 5 in which said one edge comprises said front edge.

7. A variable resistance slide control as claimed in claim 6 in which said intermediate disposition of said second longitudinally disposed guide surface comprises disposing said second longitudinally disposed guide surface intermediate of said first rail and said front edge.

8. A variable resistance slide control as claimed in claim 6 in which said intermediate disposition of said second longitudinally disposed guide surface comprises disposing said second longitudinally disposed guide surface intermediate of said first rail and said mounting surface.

9. A variable resistance slide control as claimed in claim 7 in which said slider block portion includes an apron portion having a fourth guide surface; and said receiving of planar guiding of said control operating means comprises said fourth guide surface of said apron portion and said second longitudinally disposed guide surface.

10. A variable resistance slide control as claimed in claim 9 in which said longitudinally disposed slot includes a lower edge that is proximal to said outer surface and an upper edge that is distal from said outer surface; and said top surface of said first rail includes an apex that is in raised parallel relationship to said lower edge of said slot with respect to said outer surface of said base; whereby said first rail provides a partial barrier for the exclusion of foreign matter from said resistance element.

11. A variable resistance slide control as claimed in claim 10 in which said resistance and collector means comprises an elongated resistance element being disposed proximal to said first rail, and an elongated collector member being disposed intermediate of said resistance element and said second rail.

12. A variable resistance slide control as claimed in claim 5 in which said terminal means includes crimped tabs that extend through said outer surface of said dielectric base; and said dielectric base includes stepped setoff means, that extends outwardly from said outer surface, for spacing said crimped tabs away from any adjacent conductive structure.

13. A variable resistance slide control as claimed in claim 5 in which said slider block portion includes side wall means, depending downwardly toward said resistance and collector means; and said moving of said contactor means longitudinally comprises moving said side wall means.

14. A variable resistance slide control as claimed in claim 5 in which said contactor means includes formed and unformed portions, and an elongated aperture having ends that are in said unformed portion;

said slider block portion includes protrusion means for engaging said ends of said elongated aperture; and said means for moving said contactor means comprises said protrusion means.

* * * * *